US008870133B1

(12) United States Patent
Brown

(10) Patent No.: US 8,870,133 B1
(45) Date of Patent: Oct. 28, 2014

(54) BONFIRE STAND

(71) Applicant: Charles Brown, Prudenville, MI (US)

(72) Inventor: Charles Brown, Prudenville, MI (US)

( * ) Notice: Subject to any disclaimer, the term of this patent is extended or adjusted under 35 U.S.C. 154(b) by 0 days.

(21) Appl. No.: 14/045,191

(22) Filed: Oct. 3, 2013

Related U.S. Application Data

(60) Provisional application No. 61/803,135, filed on Mar. 19, 2013.

(51) Int. Cl.
*A45F 3/44* (2006.01)
*F23H 17/08* (2006.01)
*A47F 5/04* (2006.01)

(52) U.S. Cl.
CPC *F23H 17/08* (2013.01); *A45F 3/44* (2013.01); *A47F 5/04* (2013.01)
USPC ..... 248/156; 211/196

(58) Field of Classification Search
CPC ..... A47G 25/0664; A47G 25/0685; A47G 7/025; A47F 5/04; A47F 5/06; A47F 7/0028; D06F 57/02; D06F 57/04; D06F 57/08; A41G 1/007; A45F 3/44; E04H 12/2215; E04H 12/2238; E04H 12/2223; E04H 15/62; B65F 1/141; F24B 1/193; F23H 17/08
USPC ..... 211/1.3, 196, 205, 197, 49.1, 60.1, 211/13.1; 248/156, 530, 507, 508, 533; 135/98, 99, 147, 151, 156, 159, 118; 126/30, 9 R, 9 B, 298; 110/233, 317, 110/318; D23/403
See application file for complete search history.

(56) References Cited

U.S. PATENT DOCUMENTS

| | | | | | |
|---|---|---|---|---|---|
| 345,741 | A * | 7/1886 | Thurston | 211/172 |
| 2,270,325 | A * | 1/1942 | Matthews | 174/7 |
| 2,597,157 | A * | 5/1952 | Martino | 248/150 |
| 3,021,960 | A * | 2/1962 | Pipe | 211/205 |
| 3,076,557 | A * | 2/1963 | Husted et al. | 211/196 |
| 3,197,034 | A * | 7/1965 | Deadrick | 211/205 |
| 3,225,656 | A * | 12/1965 | Flaherty et al. | 89/37.04 |
| 3,857,493 | A * | 12/1974 | Bourne | 211/197 |
| 3,908,946 | A * | 9/1975 | George et al. | 248/188.7 |
| 4,131,108 | A * | 12/1978 | Bauder | 126/298 |
| 5,161,561 | A * | 11/1992 | Jamieson | 135/16 |
| 5,318,189 | A * | 6/1994 | Lee | 211/205 |
| 5,331,764 | A * | 7/1994 | Sun | 47/45 |
| 5,636,754 | A * | 6/1997 | Ennis | 211/70.2 |
| 5,722,389 | A * | 3/1998 | Cranberg | 126/540 |
| 5,931,085 | A * | 8/1999 | Benzschawel | 99/449 |
| 6,216,382 | B1 * | 4/2001 | Lindaman | 43/2 |
| 6,435,172 | B1 * | 8/2002 | Freemon | 126/25 B |
| 6,568,546 | B1 * | 5/2003 | Huang | 211/205 |
| 6,584,967 | B1 * | 7/2003 | Paumen et al. | 126/30 |
| 6,637,713 | B1 * | 10/2003 | Kleve et al. | 248/440.1 |
| 6,732,985 | B1 * | 5/2004 | Cantrell | 248/125.1 |
| 6,935,065 | B1 * | 8/2005 | Oliver | 42/94 |
| 7,207,450 | B1 * | 4/2007 | Franklin et al. | 211/205 |
| 7,980,520 | B2 * | 7/2011 | Taylor | 248/156 |

(Continued)

*Primary Examiner* — Jennifer E Novosad
(74) *Attorney, Agent, or Firm* — L.C. Begin & Associates, PLLC.

(57) ABSTRACT

A stand is provided for supporting a portion of a combustible member. The stand includes a base portion and a plurality of branch portions. Each branch portion extends in a direction away from the base portion such that a cavity is formed between each branch portion and another branch portion adjacent the branch portion.

6 Claims, 3 Drawing Sheets

(56) References Cited

U.S. PATENT DOCUMENTS

| | | | | |
|---|---|---|---|---|
| 8,459,247 | B1 * | 6/2013 | Bourgeois et al. | 126/40 |
| 2002/0185167 | A1 * | 12/2002 | Lin et al. | 135/16 |
| 2003/0079766 | A1 * | 5/2003 | Arrowood et al. | 135/16 |
| 2004/0065802 | A1 * | 4/2004 | Clasen | 248/530 |
| 2004/0144379 | A1 * | 7/2004 | Lewis | 126/30 |
| 2009/0007479 | A1 * | 1/2009 | Jerome, Sr. | 43/2 |
| 2009/0189030 | A1 * | 7/2009 | Krasnicki | 248/156 |
| 2011/0006173 | A1 * | 1/2011 | Sargent | 248/156 |
| 2014/0060516 | A1 * | 3/2014 | Delaquis | 126/298 |

* cited by examiner

BONFIRE STAND

CROSS-REFERENCE TO RELATED APPLICATIONS

This application claims the benefit of U.S. Provisional Application Ser. No. 61/803,135, filed on Mar. 19, 2013, the disclosure of which is incorporated herein by reference in its entirety.

BACKGROUND OF THE INVENTION

The embodiments of the present invention relate to a stand for supporting wood and/or other combustible materials (for example, a combustible member such as a log) in a predetermined configuration for burning.

SUMMARY OF THE INVENTION

In one aspect of the embodiments described herein, a stand is provided for supporting a portion of a combustible member. The stand includes a base portion and a plurality of branch portions. Each branch portion extends in a direction away from the base portion such that a cavity is formed between each branch portion and another branch portion adjacent the branch portion.

DETAILED DESCRIPTION

Figure 1:
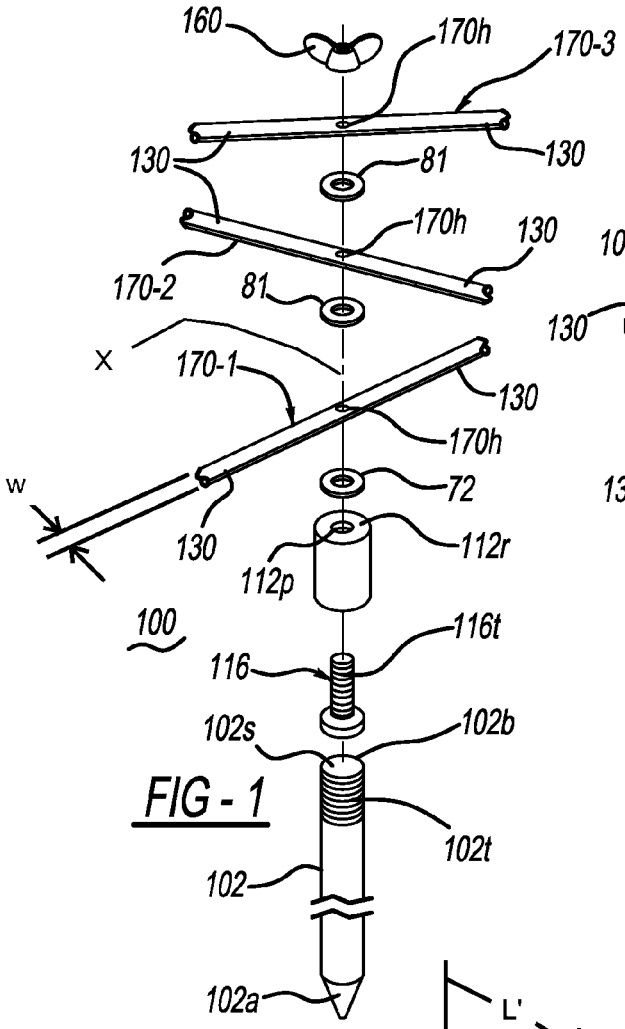
FIG. 1 is an exploded perspective view of a bonfire stand in accordance with one embodiment of the present invention.
Figure 2:
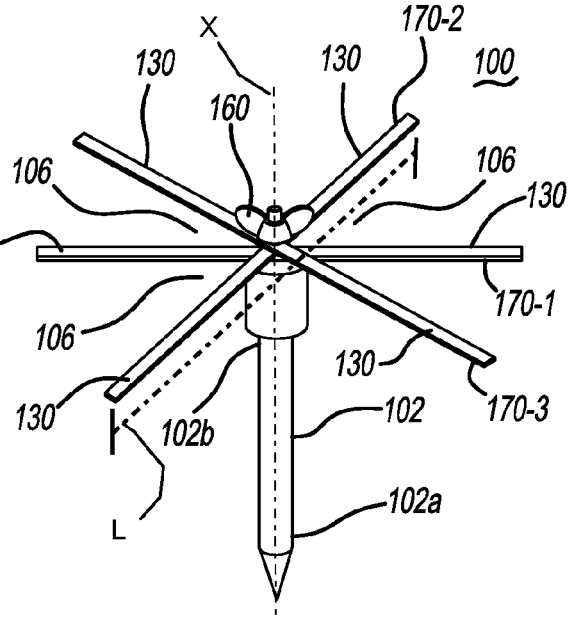
FIG. 2 is a perspective view of the stand shown in FIG. 1 in an assembled condition.
Figure 3:
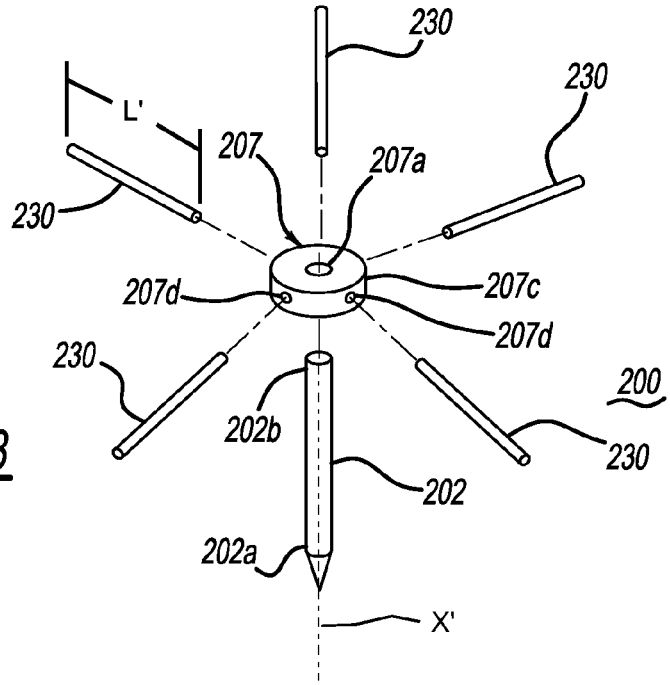
FIG. 3 is an exploded perspective view of a bonfire stand in accordance with another embodiment of the present invention.
Figure 7:
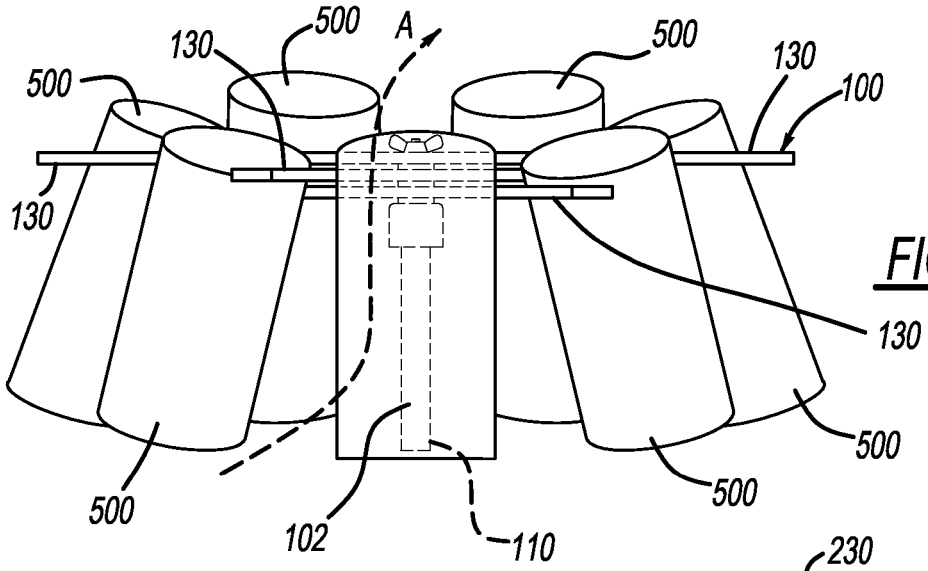
FIG. 7 is a side view of the embodiment shown in FIGS. 1, 2 and 4, showing fire logs supported by the stand.
Figure 8:
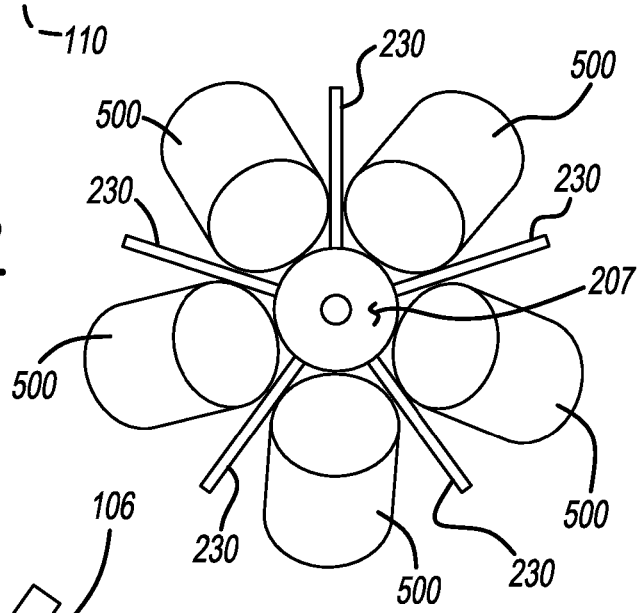
FIG. 8 is a plan view of the view shown in FIG. 6.
Figure 9:
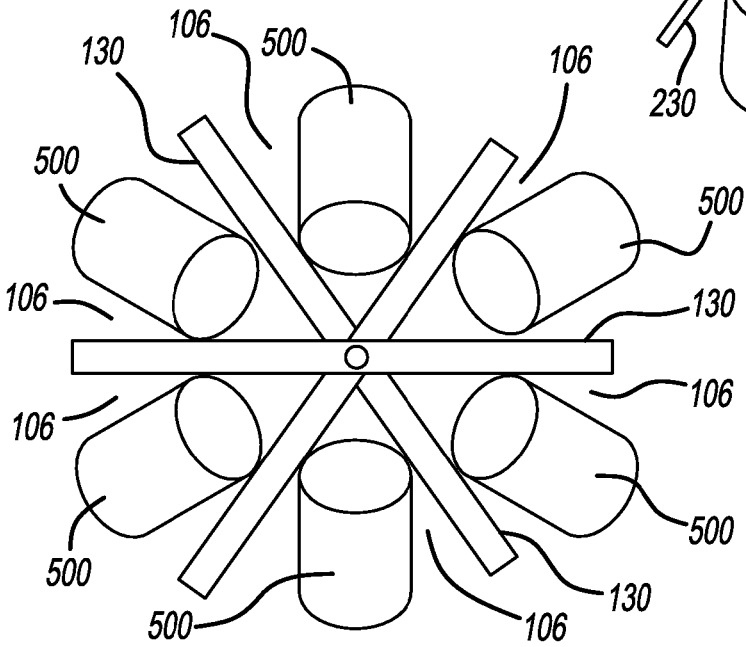
FIG. 9 is a plan view of the embodiment shown in FIG. 7.

FIG. 1 is an exploded perspective view of a bonfire stand 100 in accordance with one embodiment of the present invention. FIG. 2 is a perspective view of the stand shown in FIG. 1 in an assembled condition. In the embodiment shown in FIGS. 1 and 2, stand 100 includes a base portion 102 and a plurality of branch portions 130 extending radially outwardly from the base portion 102 so as to form a cavity 106 between each pair of adjacent branch portions 130. Each of cavities 106 is structured to receive therein an associated log 500 or other similarly shaped piece or collection of combustible material, as shown in FIGS. 7 and 9.

Figure 4:
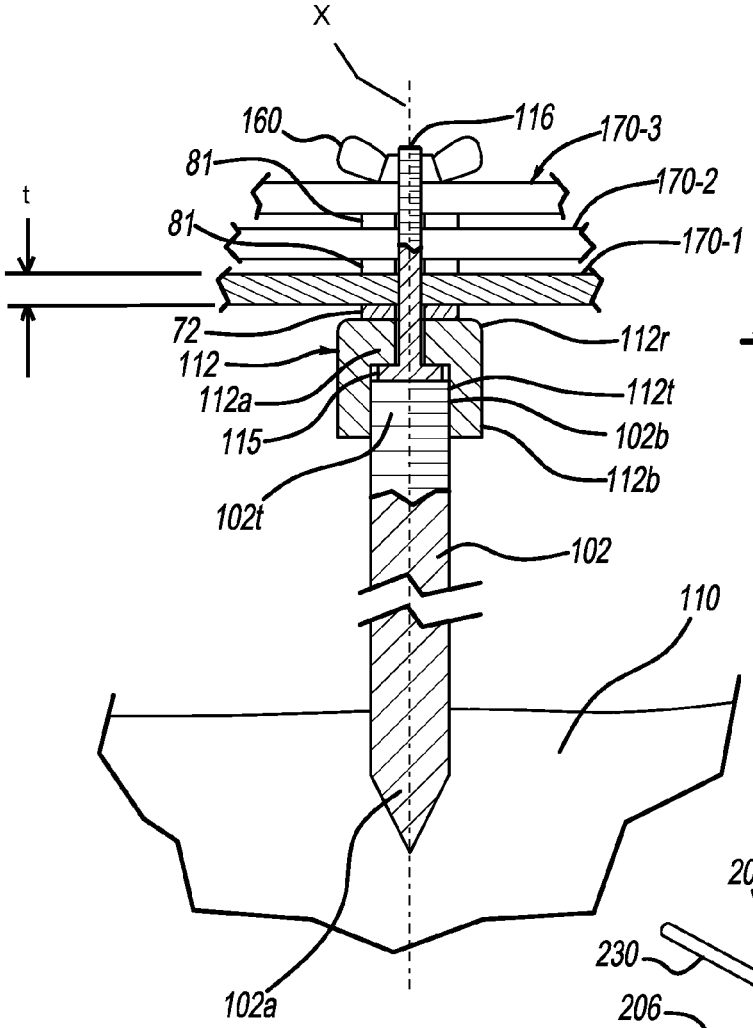
FIG. 4 is a partial cross-sectional detail view of an end portion of the embodiment shown in FIGS. 1 and 2.
Figure 5:
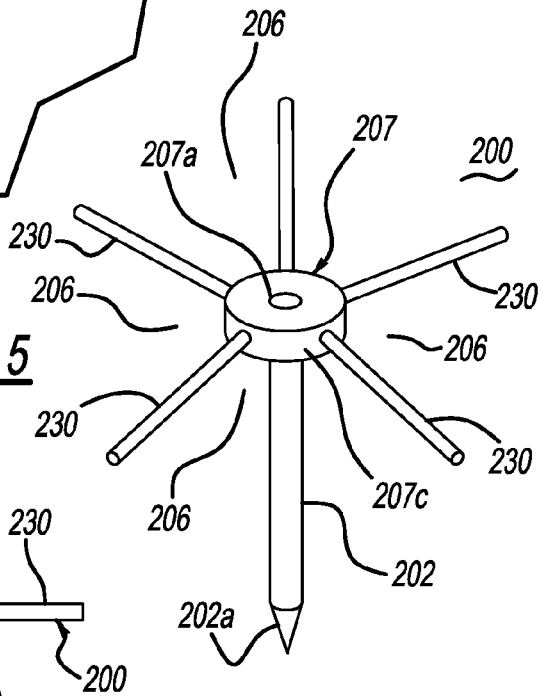
FIG. 5 is a perspective view of the stand shown in FIG. 3 in an assembled condition.
Figure 6:
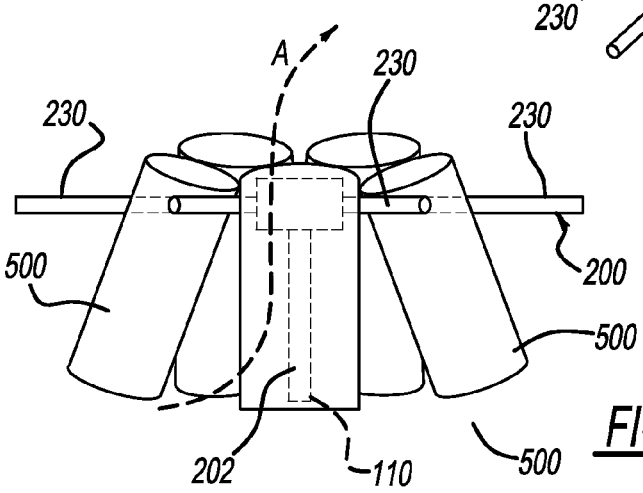
FIG. 6 is a side view of the embodiment shown in FIGS. 3 and 5, showing fire logs supported by the stand.

Base portion 102 is structured to be insertable into the ground 110, for example, at a campsite or in a yard. When inserted into the ground, the base portion stands vertically as shown in FIGS. 4, 7, and 9. Base portion 102 has a first end 102*a* and a second end 102*b* opposite the first end. In one embodiment, first end 102*a* is conical, tapered, pointed or otherwise formed so as to facilitate insertion of the base portion into the ground. In the embodiment shown in FIGS. 1 and 2, base portion 102 is formed from a metallic material (for example, steel pipe, bar stock or tubing) or any other material suitable for maintaining the structural integrity of the base portion and for performing the functions of the device as described herein. In a particular embodiment, base portion second end 102*b* is structured so as to provide a flat bearing surface 102*s* for the mounting of a branch portion (described below) thereon.

In one embodiment, base portion second end 102*b* has a series of external threads 102*t* formed therealong. Threads 102*t* are engageable with complementary threads 112*t* formed along an interior surface of a cap 112 as described below.

Referring to FIGS. 1 and 4, in one embodiment, a cap 112 is provided for mounting on base portion second end 102*b*. Cap 112 may be structured to provide a flat bearing surface 112*r* for the mounting of a branch portion 130 (described below) thereon, when the cap is secured to the base portion second end. In an alternative embodiment, a washer 72 or another piece having at least one flat side is attached to the cap 112 to provide the desired bearing surface.

In one embodiment, cap 112 has a base 112*a* and an annular wall 112*b* extending from a periphery of the base. Base 112*a* has a through-hole 112*p* formed therein. An internal surface 112*s* of wall 112*b* is provided with threads 112*t* for engaging complementary threads formed along base portion second end 102*b*, to secure the cap to the base portion.

Cap 112 is also structured such that, when mounted to the base portion second end, a cavity 115 is formed between cap base 112*a*, cap wall 112*b*, and base portion second end 102*b*. This cavity is structured for receiving and retaining therein the head portion 116*h* of a bolt or threaded stud 116. The threaded shank 116*t* of the bolt then extends through the cap opening 112*p* so that the threaded portion is exposed.

As seen in FIG. 4, a plurality of branch members 170 are stacked along the threaded shank portion 116*t* of bolt 116 when the bolt is secured at base portion second end 102*b*. The length of the bolt 116 positioned within cavity 115 may be varied so as to accommodate different numbers and/or thicknesses of branch members.

In the embodiment shown in FIGS. 1, 2, 4, 7 and 9, branch members 170 are attached to base portion second end 102*b*. In the embodiment shown in these figures, each branch member 170 is provided having a pair of opposed ends 170*a*, 170*b* and a longitudinal body 170*c* connecting the ends. A through-hole 170*h* is formed at or near the center of the body 170*c* of each branch member. In this configuration, each branch portion 130 is formed by the portion of a respective branch member body 170*c* that extends between hole 170*h* and a respective one of ends 170*a* and 170*b*. Thus, each branch member 170 forms two branch portions 130 extending in opposite directions.

Hole 170*h* is structured such that bolt threaded portion 116*t* will fit into the hole, to enable stacking of the branch members 170 along the bolt 116 as shown in FIG. 4. In this configuration, when the branch members 170 are stacked and arranged as described below, opposed portions of each branch member body 170*c* forming respective ones of branch portions 130 extend generally radially outwardly in opposite directions and away from hole 170*h* and base portion 112.

In the embodiment shown in FIGS. 1, 2, 4, 7 and 9, a spacer 81 (for example, a conventional metal washer) is provided between adjacent ones of the stacked branch members. Alternatively, the branch members 170 may be stacked in direct contact with each other.

A first one of the branch members 170-1 is mounted onto base portion second end 102*b* by positioning the branch member hole 170*h* over the bolt 116 and moving the branch member along the bolt until the branch member contacts and rests against the bearing surface formed by cap base 112*a* (or washer 72, if such a washer is used for this purpose). The remaining branch members 170-2 and 170-3 are then stacked on top of the first branch member 170-1.

When attached to base portion second end 102*b*, the branch portions 130 formed by branch members 170 may be angularly spaced apart and extend generally radially outwardly from the base portion 102 so as to form cavities 106. After stacking, the branch members 170 may be manipulated so that the branch portions 130 formed by the respective branch members are angularly spaced apart as desired to accommodate fire logs in the cavities 106 formed therebetween. The angular spacing between the adjacent branch portions 130 may be adjusted by rotating branch members 170 about bolt 116 with respect to each other, so as to adjust the sizes of the cavities 106 formed between adjacent branch portions 130.

In one embodiment, adjacent branch portions 130 are equally angularly spaced with respect to each other about a central axis (X) extending through the base portion so as to form cavities 106 of substantially the same size. Alternatively, the angular spacing between adjacent branch portions may be arranged to provide cavities of different sizes, to accommodate various different sizes of logs therein.

In another example, a relatively greater number of branch members 170 can be stacked together and angularly arranged so as to provide a correspondingly greater number of branch portions 130 and cavities 106 formed therebetween. Although the figures show three branch members, any desired number of branch members may be employed, according to the needs of a particular application. In a particular embodiment, each branch member 170 is formed from a metal slat having a thickness dimension t (as seen in FIG. 4) within the range 1/16 inch 1/4 inch inclusive. In a more particular embodiment, each branch member 170 is formed from a metal slat having a thickness dimension of 1/4 inch. Also, in a particular embodiment, each branch member 170 is formed from a metal slat having a width dimension w (as seen in FIG. 1) within the range 1/2-1 inch inclusive. In a more particular embodiment, each branch member 170 is formed from a metal slat having a width dimension w of 3/4 inch.

The height above ground at which the branch portions 130 reside may be controlled by adjusting the depth to which base portion first end 102*a* is inserted into the ground. This facilitates the arrangement and support of logs of various lengths within the cavities 106, as described herein.

After the desired number of branch members are stacked on top of the cap and angularly oriented as desired, a complementarily threaded nut 160 (such as a wing nut) or other suitable securement mechanism may be applied to bolt threaded portion 116*t* to secure the stacked branch members in the desired orientation at the second base portion end 102*b*. However, the branch members may be secured to base portion 102*a* using any method that will hold the branch portions 130 in a desired orientation during use of the bonfire stand.

In a particular embodiment, each of branch members 170 has a length L within the range of 18 inches to 24 inches inclusive, with a through hole 170*h* positioned midway between the opposite ends of each branch member. In a more particular embodiment, each of branch members 170 has a length L of 20 inches, with a through hole 170*h* positioned midway between the opposite ends of each branch member, thereby providing branch portions 130 having lengths of approximately 10 inches, extending from the center of the through hole to respective ends of the branch member. However, the branch members 170 may any of a variety of suitable alternative lengths. In addition, the branch members 170 attachable to a particular bonfire stand 100 may have different lengths if desired for a particular application.

In a particular embodiment, base portion 102 has a length of about 2 feet. However, the base portion may any of a variety of suitable alternative lengths, structured so as to permit the base portion to be inserted into the ground to a desired depth for supporting logs, sticks or other combustible materials of different lengths, while providing a stable support for the combustible materials.

In a particular embodiment, bolt 116 is directly secured to base portion second end 102*b* using a weld or other suitable method.

In a particular embodiment, bolt 116 is directly secured to cap 112 using a weld or other suitable method.

In a particular embodiment, cap 112 is directly secured to base portion second end 102*b* using a weld or other suitable method.

In a particular embodiment, element 116 is a threaded stud welded or otherwise secured to cap 112 and/or to base portion second end 102*b* using a weld or other suitable method.

In a particular embodiment, to simplify packaging of the bonfire stand and help ensure that smaller components of the assembly do not get lost, washers 72 and/or 81 are placed onto bolt or threaded stud 116 and secured thereon by nut 160 for storage and transport. The branch members 170 can then be secured to each other and/or to base portion 102 for storage and transport.

FIGS. 3, 5, 6, and 8 show a bonfire stand 200 in accordance with another embodiment of the present invention. Stand 200 of FIGS. 3, 5, 6, and 8 includes a base portion 202 and a branch portion support 207 connecting the branch portions 230 to the base portion 202.

Base portion 202 has a first end 202*a* insertable into the ground 110 and a second end 202*b* opposite the first end. First end 202*a* may be conical, tapered, pointed or otherwise formed so as to facilitate insertion of the base portion into the ground, similar to base portion first end 102*a* previously described. In the embodiment shown in FIGS. 3, 5, 6, and 8, base portion 202 is formed from wood, wood by-product or other combustible or flame-consumable material so that the base portion 202 combusts along with the fire logs supported by the bonfire stand. The wooden base portion 202*a* is of a suitable thickness and composition so that the bonfire stand can support the firewood arranged therearound for a period sufficient for the firewood to ignite and burn for a period of time, before the base portion 202 is consumed or rendered structurally inoperable for its purpose by the fire.

In the embodiment shown in FIGS. 3, 5, 6, and 8, branch portion support 207 is circular in configuration, although the support 207 may have any shape suitable for the purposes described herein. Support 207 has a hole 207*a* formed at or proximate the center thereof along a first side 207*b* of the support. Hole 207*a* is structured such that an inner wall of the hole engages the base portion second end 202*b* in an interference fit when the second end is inserted into hole 207*a*, thereby attaching the support to the base portion. Alternatively, the base portion end may be secured in hole 207*a* using an adhesive or by any other suitable method.

Support 207 also has a peripheral edge 207*c* including a plurality of spaced apart holes 207*d* formed therealong. Each of holes 207*d* is structured such that an inner wall of the hole engages an end of an associated branch portion 230 in an interference fit when the branch portion end is inserted into hole 207*d*, thereby attaching the branch portion to the support. Alternatively, the branch portions may be secured in holes 207*d* using an adhesive or by any other suitable method.

Each of holes 207*d* is structured such that a straight branch portion 230 inserted into the hole extends in a direction radially outwardly from base portion 202. In this manner, the branch portions 230 are effectively angularly spaced apart in the same manner shown in FIGS. 1, 2, 4, 7 and 9 of the previously described embodiment. The spaced apart branch portions 230 thus form a plurality of adjacent cavities 206 are formed extending along the periphery of the support 207 and between adjacent ones of branch portions 230, in a manner similar to that shown in FIGS. 1, 2, 4, 7 and 9 of the previously described embodiment. In a particular embodiment, adjacent branch portions 230 are equally angularly spaced with respect to each other about a central axis (X') extending through the base portion so as to form cavities 206 of substantially the same size. Alternatively, the angular spacing between adjacent branch portions may be arranged to provide cavities of different sizes, to accommodate various different sizes of logs therein.

In a particular embodiment, a relatively greater number of holes 207*d* is spaced a relatively shorter distance apart, to permit greater flexibility in positioning of the branch portions along the support periphery and/or to permit a greater number of cavities 206 to be formed along the support periphery.

Support 207 may be formed from wood or any other material or materials suitable for the purposes described herein. In a particular embodiment, support 207 is formed from a metal or other fire-resistant material to permit the support to be repeatedly re-used. Branch portion support 207 may alternatively be formed from wood, wood by-product or other combustible or flame-consumable material so that the branch portion support combusts along with the fire logs supported by the bonfire stand.

In one embodiment, branch portions 230 are formed from wood or any other material or materials suitable for the purposes described herein. In a particular embodiment, branch portions 230 are formed from wood, wood by-product or other combustible or flame-consumable material so that the Branch portions 230 combust along with the fire logs supported by the bonfire stand. In one example, branch portions 230 are formed by suitably-sized wooden dowel rods. In another particular embodiment, branch portions 230 are formed from a metal or other fire-resistant material to permit the branch portions to be repeatedly re-used.

In an embodiment where the base portion 202, support 207 and branch portions 230 are all formed from wood or some other combustible but structurally sufficient material, the entire bonfire stand forms a single-use, disposable structure usable for starting and maintaining a single fire, and which is subsequently consumed by the fire.

FIGS. 6-9 show the previously described embodiments of the bonfire stand during use. The bonfire stand 100, 200 facilitates arrangement and retention of firewood pieces 500 in a pyramidal formation, as shown in the drawings. This arrangement promotes air flow through into and through the center of the log arrangement and upward, as indicated by arrows A. this facilitates faster starting of the fire and more complete and efficient burning of the logs. In addition, when a log finishes burning within its associated cavity 106, the log can easily be replaced with another log without undue exposure of a user to the ongoing flame.

It will be understood that the foregoing description of the present invention is for illustrative purposes only, and that the various structural and operational features herein disclosed are susceptible to a number of modifications, none of which departs from the spirit and scope of the present invention. The preceding description, therefore, is not meant to limit the scope of the invention. Rather, the scope of the invention is to be determined only by the appended claims and their equivalents.

What is claimed is:

1. A bonfire stand for supporting a portion of combustible members which can be defined by a fire log or a piece of lumber, the stand comprising:

a base portion for insertion into the ground, said base portion containing a central axis; and a plurality of branch members stacked with respect to each other and secured to the base portion such that at least two cavities are formed between a first branch member and a second branch member adjacent the first branch member, each of said branch members having a first end and a second end, wherein: said central axis of the base portion passes between the first and second ends of each branch member and through each branch member; the combustible members are supportable against said branch members within each of said cavities; the plurality of branch members are stacked in a laminar fashion either in direct contact with each other or separated by a washer; and, said stand is used in a bonfire.

2. The stand of claim 1 further comprising a threaded member secured to the base portion, and wherein the branch members of the plurality of branch members are stacked along the threaded member.

3. The stand of claim 2 further comprising a cap securing the threaded member to the base portion, and wherein the plurality of branch members is stacked on a surface of the cap.

4. The stand of claim 1 wherein each branch member is secured to the base portion at a longitudinal midpoint of the branch member.

5. The stand of claim 1 wherein each branch member of the plurality of branch members defines at least one branch portion secured to the base portion at an end of the branch portion and extending from the base portion in a direction away from the base portion.

6. The stand of claim 5, wherein each branch member has a pair of opposed ends and a longitudinal body connecting the ends, and wherein each branch portion is defined by a portion of a branch member extending from a corresponding end of the branch member to a longitudinal midpoint of the branch member.

* * * * *

UNITED STATES PATENT AND TRADEMARK OFFICE

CERTIFICATE OF CORRECTION

PATENT NO. : 8,870,133 B1
APPLICATION NO. : 14/045191
DATED : October 28, 2014
INVENTOR(S) : Brown It is certified that error appears in the above-identified patent and that said Letters Patent is hereby corrected as shown below:

In the Specification

Column 4; Line 2; Please insert --be-- after may.

Column 4; Line 7; Please insert --be-- after may.

Column 5; Line 40; Please delete "Branch" and insert --branch--.

Signed and Sealed this
Thirtieth Day of December, 2014

Michelle K. Lee

Michelle K. Lee
*Deputy Director of the United States Patent and Trademark Office*